United States Patent [19]

Schuster

[11] Patent Number: 5,052,034

[45] Date of Patent: Sep. 24, 1991

[54] X-RAY GENERATOR

[75] Inventor: Manfred Schuster, Munich, Fed. Rep. of Germany

[73] Assignee: Siemens Aktiengesellschaft, Munich, Fed. Rep. of Germany

[21] Appl. No.: 604,951

[22] Filed: Oct. 29, 1990

[30] Foreign Application Priority Data

Oct. 30, 1989 [EP] European Pat. Off. ..... 89120143.6

[51] Int. Cl.[5] ..... H01J 35/00; H01J 35/14; H01J 35/10

[52] U.S. Cl. ..... 378/121; 378/130; 378/138; 378/141; 378/143

[58] Field of Search ..... 378/121, 143, 141, 130, 378/138

[56] References Cited

U.S. PATENT DOCUMENTS

| | | | |
|---|---|---|---|
| 2,665,390 | 1/1954 | Zunick et al. | 378/141 |
| 3,646,380 | 2/1972 | Hartl | 378/129 |
| 4,238,682 | 12/1980 | Vratny | 378/141 |
| 4,264,818 | 4/1981 | Petersen | 378/141 |
| 4,266,138 | 5/1981 | Nelson, Jr. et al. | 378/141 |
| 4.357,555 | 11/1982 | Gerkema et al. | 378/135 |
| 4,455,504 | 6/1984 | Iversen | 378/141 |

FOREIGN PATENT DOCUMENTS

| | | |
|---|---|---|
| 0136762 | 4/1985 | European Pat. Off. . |
| 0300808 | 1/1989 | European Pat. Off. . |
| 890246 | 7/1949 | Fed. Rep. of Germany . |
| 2108149 | 5/1972 | France . |

OTHER PUBLICATIONS

"Chemical Analysis of Surfaces by Total-Reflection-Angle X-Ray Spectroscopy in RHEED Experiments (RHEED-TRAXS)", Hasegawa et al., Japanese Journal of Applied Physics, vol. 24, No. 6, Jun. 1985, pp. L387-L390.

"A Metal/Ceramic Diagnostic X-Ray Tube", Hartle et al., Philips Tech. Rev., vol. 41, No. 4, 1983/84, pp. 126-134.

"Röntgenabalyse", Urlaub, vol. 1, pp. 71-101.

"X-Ray and Neutron Scattering from Rough Surfaces", Sinha et al., Physical Review B, vol. 38, No. 4, Aug. 1988, pp. 2297-2311.

"Metallic Multilayers for X Rays Using Classical Thin-Film Theory", Vidal et al., Applied Optics, vol. 23, No. 11, Jun. 1984, pp. 1794-1801.

*Primary Examiner*—Edward P. Westin
*Assistant Examiner*—Kim-Kwok Chu
*Attorney, Agent, or Firm*—Hill, Van Santen, Steadman & Simpson

[57] ABSTRACT

An X-ray generator has an anode formed by an electrically conductive fluid having a flat surface on which focused electrons are incident, so that X-rays are generated at a solid angle with respect to the surface, with $\alpha_{2C}$ being the critical angle of total reflection. For enhancing the spectral brilliance of the X-rays, a method and apparatus are disclosed wherein X-rays at a specific angle $\alpha_2$ are tapped (the "tap angle"), with $\alpha_2$ satisfying the condition $\alpha_{2C} < \alpha_2 < 3\alpha_{2C}$.

14 Claims, 7 Drawing Sheets

X-RAY GENERATOR

BACKGROUND OF THE INVENTION

1. Field of the Invention

The present invention is directed to x-ray generators, and in particular to x-ray generators having an electrically conductive liquid forming the anode (or anti-cathode).

2. Description of the Prior Art

So-called liquid anode x-ray tubes are described, for example, in U.S. Pat. No. 2,665,390 and in German Pat. No. 890,246. X-ray sources for medical diagnostics are disclosed in U.S. Pat. No. 4,357,555, in EP-A-0 136 762 and in Philips Tech. Rev. 41, 1983/84 No. 4, pages 126 through 134. The x-ray tubes known from J. Urlaub, Rontgenanalyse Vol. 1: Rontgenstrahlen und Detektoren (Siemens, Karlsruhe 1974) pages 71 through 75 are usually used for fine-structure examinations.

X-ray sources having high spectral brilliance are required for implementing highly sensitive x-ray analysis methods (total reflection x-ray fluorescence analysis, reflectometry, interferometry, diffractometry, etc.). Because synchrotrons, the most intense x-ray light sources known at present, are not available as laboratory sources, attempts have been made to enhance the brilliance of conventional x-ray tubes by applying the following techniques:

Diminishing the electron focus on the anode (increasing the power density of the electron beam)

Employing a rotating anode (distribution of the thermal stress onto the generated surface of a rapidly rotating anode)

Diminishing the effective x-ray emission area with a flat beam tap [sic] (see, for example, J. Urlaub, Rontgenanalyse Vol. 1, pages 96 through 98).

For fixed anodes as well as rotating anodes the brilliancy obtainable with these techniques is already exhausted to the limit values of the material. Moreover, the use of rotating anodes presents considerable technical difficulties because the rotary transmission leadthroughs required for the drive of the anode and for the circulation of the coolant must still reliably seal the coolant circulation and the evacuated tube housing even given speeds of up to 6000 rpm. Despite complicated designs, leaks repeatedly lead to outages. Moreover, the electron beam effects a high local heating of the anode, as a result of which the anode is subjected to extreme mechanical stress and therefore ages extremely rapidly. Cracks form with increasing operating duration. Due to the more pronounced self-absorption, this effects a loss of brilliance. Additionally, the cracks can lead to the leakage of coolant into the tube vacuum. The high local heating of the anode can also cause an evaporation of anode material and can lead to arcing given the high electrical field strengths.

SUMMARY OF THE INVENTION

The object of the invention is to specify an x-ray generator of the species initially cited that is simply constructed and has high brilliance.

The above object is achieved in accordance with the principles of the present invention in a method and apparatus wherein the x-rays in the x-ray concentration generated at the surface of a liquid anode are tapped at a specific tap angle $\alpha_2$, wherein $\alpha_2$ satisfies the condition $\alpha_{2C} < \alpha_2 < 3\alpha_{2C}$, wherein $\alpha_{2C}$ is the critical angle of total reflection.

A first advantage obtainable with the invention is that the brilliance of an x-ray tube can be generally improved because liquid anodes can bear a higher electron beam power density (no formation of cracks, better heat elimination due to blending). A second advantage is that the brilliance can be additionally enhanced energy-selectively or wavelength-selectively with x-ray optical effects given a flat beam tap. The prerequisite therefor, a smooth anode surface, is ideally met by liquid anodes.

DESCRIPTION OF THE PREFERRED EMBODIMENT

Figure 1:
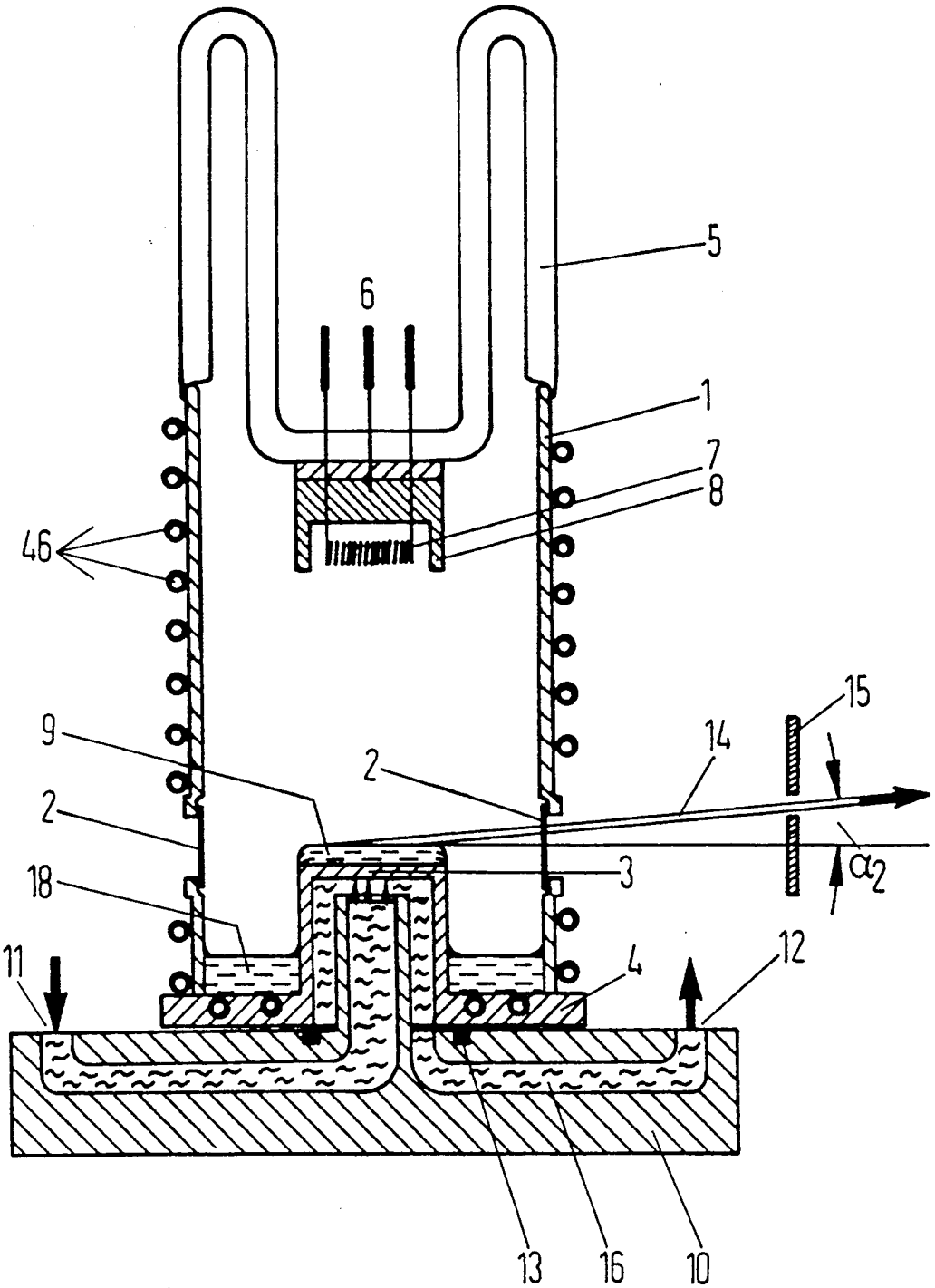
FIG. 1 is a side sectional view of a first exemplary embodiment of an x-ray generator constructed in accordance with the principles of the present invention.

The x-ray generator schematically shown in FIG. 1 has a housing formed by a metal wall 1, with beam exit windows therein, an anode carrier consisting of an upper side 3 and a base 4, and a glass high-voltage leadthrough 5. A glow helix 7, forming the cathode arranged in the high-vacuum of the housing and is connected to voltage leads 6 of a Wehnelt electrode 8 for focusing the electrons emitted by the glow helix 7 onto a liquid anode 9 during operation. For cooling the anode liquid 9, which completely wets the upper side 3 of the anode carrier (a flow-off is prevented by the surface tension), water 16 or some other coolant is brought to the supporting base 4 of the anode via a channel 11 in a fastening flange 12, and is carried away via a channel 12. Sealing of the coolant circulation between the supporting base 4 of the anode carrier and the fastening flange 10 ensues with an O-ring 13. No noteworthy shrinkage of anode fluid 9 due to evaporation will occur during operation of the x-ray generator with low power insofar as the anode fluid 9 is adequately cooled. At high tube powers, however, the evaporation rate increases considerably, so that the loss of material can no longer be left out of consideration. As a result of intensive cooling of the anode carrier and simultaneous heating of the remaining tube housing, particularly of the anode liquid reservoir 18 with the assistance of the heating conductor 46, however, it can be assured that the evaporated anode fluid condenses again on the upper side 3 of the anode carrier. A dynamic equilibrium is established between evaporation rate and condensation rate because the cooling action increases with decreasing density of the anode fluid 9. The heating and cooling capacities are thereby selected such that the housing pressure does not exceed 10 (−9) bar during operation.

Metals having a low melting point MP and high boiling point BP as well as low vapor pressure and high thermal conductivity, particularly gallium Ga, indium In, tin Sn and their alloys, may be used as anode materials. The melting points MP and boiling points BP of the metals Ga, In and Sn are recited in Table 1. The heating by the electron beam is generally so high that no additional heating means are required for liquefying the anode material.

TABLE 1

| | MP | BP |
|---|---|---|
| Ga: | 29.5° C. | 2064° C. |
| In: | 156.2° C. | 2050° C. |
| Sn: | 231.8° C. | 2700° C. |

Liquids have a low surface roughness and, if vibrations are avoided, also have a low ripple. Because the mean roughness of liquids (thermically excited capillary waves) typically lies below 1 nm given temperatures $T << T_{BP}$ that are not excessively high, it is possible to tap the x-radiation 14 emitted by the anode 9 at extremely flat angles $\alpha_2 < 1°$. This is of significance particularly for enhancing the spectral brilliance of the x-ray generator. What is referred to as spectral brilliance $B_E$ is the quantity $$B_E = d^4N_\nu/(dt \cdot dA_2 \cdot d\Omega_2 \cdot dE\nu) = \text{photons}/(s \cdot \text{mm}^2 \cdot \text{mrad}^2 \cdot eV) \quad (1)$$

wherein $N_\nu$ is the number of photons emitted per time interval Dt, solid angle element $d\Omega_2$ and energy interval $dE\nu$ with reference to the effective size $dA_2$ of the x-ray source.

The concentration of the x-radiation 14 generated in surface-proximate layers of the anode and emerging into the vacuum that is described in Jap. Journ. of Appl. Phys., Vol. 24, No. 6, 1985, pages L387 through L390 is utilized for increasing the spectral brilliance $B_E$ of the x-ray generator. Since these effects produced by diffraction only take effect in the region of the exit limit angle $\alpha_{2C}$, the tap angle $\alpha_2$ prescribed by the diaphragm 15 should satisfy the relationship $$\alpha_{2C} < \alpha_2 < 3\alpha_{2C} \quad (2)$$

The exit limit angle $\alpha_{2C}$, which corresponds to the critical angle of the total reflection and is dependent on the photon energy $E_\nu$ as well as on the anode material employed, is calculated from the dispersion part of the refractive index $$n = 1 - \delta - i\beta \quad (3)$$

according to the equation $$\alpha_{2C} = (2\delta(E\nu))^{\frac{1}{2}} \quad (4)$$

The quantity $\beta$ is thereby related to the absorption coefficient $\mu$ via $$\mu = 4\pi E_\nu \beta/(hc) \quad (5)$$

Given high photon energies $E_\nu > E_{AK}$($E_{AK}$: energy of the K-shell absorption edge), $\delta$ is approximately established by $$\delta = \frac{r_0 N_A h^2 c^2}{2\pi e^2} \cdot \frac{\zeta \cdot Z}{A_r E_\gamma^2} \quad (6)$$

-continued $$\approx 207 \frac{\text{cm}^3 eV^2}{g} \frac{\zeta}{E_\gamma^2}$$

wherein $r_o$: classic electron radius $N_A$: Avogadro's number h: Planck's constant c: speed of light in a vacuum e: elementary charge $\rho$: density of the anode material Z: nuclear charge number of the anode material $A_r$: relative atomic mass of the anode material $E_\nu$: photon energy.

Typical values of the exit boundary angle $\alpha_{2C}$ lie at 0.5°. Since the x-ray-optical properties of the anode surface in the region of extremely small tap angles (see equation (2)) are exploited in the instant invention for enhancing the brilliance, the highest demands are to be made of the flatness of the anode surface.

In order to guarantee a defined tap angle $\alpha_{2C}$ in this angular range and to prevent a beam widening, the ripple cannot exceed $0.1\alpha_{2C}$. Too great a ripple would cause the radiation to experience refraction in different exit directions at the differently inclined facets of the anode surface. This would result in a smearing of the emerging x-ray intensity over the exit angle $\alpha_2$, and thus in a reduction of the increase in brilliance obtainable on the basis of the flat beam tap. In addition to the ripple that covers the long-wave, gently oscillating part of the anode unevenness, the roughness that describes the short-wave oscillations is also of significance. This roughness causes an interference both in the transmitted and the reflected x-rays. The intensity of the radiation reflected back into the anode is diminished as a result thereof and the intensity of the transmitted radiation is increased to the same degree. The increase of the transmitted intensity, however, partly ensues in the form of diffuse radiation that contributes nothing to enhancing the brilliance. Overall, the influence of the roughness on the transmitted intensity is slight due to the moderate reflectivity when the mean roughness $\sigma$ of the anode surface satisfies the condition $$\sigma \lesssim \lambda/(4\pi(\sin\alpha_1 \cdot \sin\alpha_2)^{\frac{1}{2}}) \quad (7)$$

($\lambda$: wavelength, $\lambda = hc/E_\nu$). This condition can be derived from the works by B. Vidal and P. Vincent, Applied Optics, 23 No. 11 (1984) pages 1794 through 1801 and S. K. Sinha, E. B. Sirota, S. Garoff and H. B. Stanley, Phys. Rev. B38 No. 4 (1988) pages 2297 through 2311. For Ga-$K_\alpha$ radiation from a liquid Ga anode with $\alpha_2 = 1.5\alpha_{2C} = 1.5(0.28°)$, this means $\sigma < 2$ nm. Such a demand can be met with high-gloss, polished solid anodes and, in particular, with liquid anodes.

Figure 2:
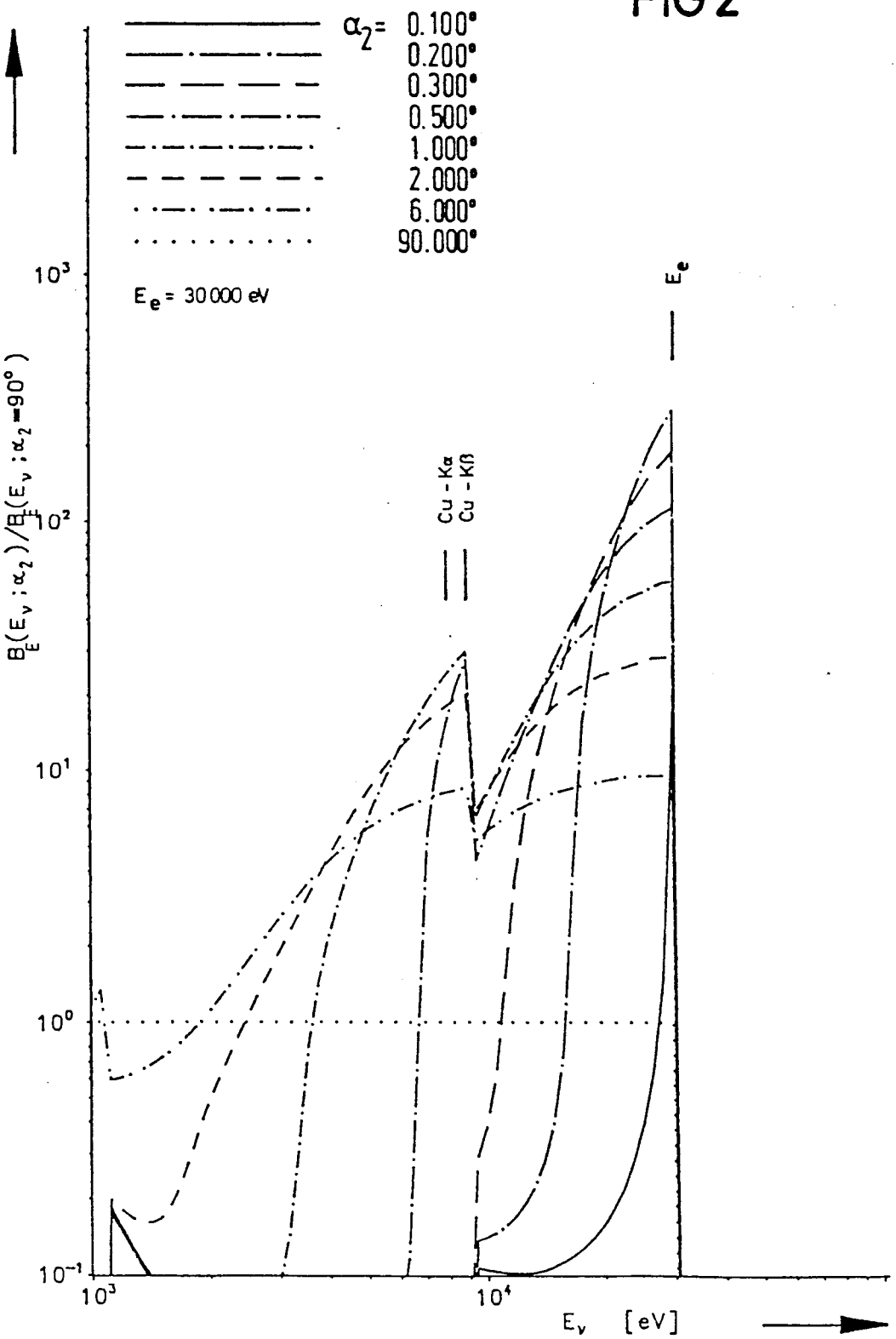
FIG. 2 is a graph showing the relative brilliance of an x-ray generator constructed in accordance with the principles of the present invention dependent on the tap angle $\alpha_2$ and on the photon energy $E\nu$.

The gain in brilliance $B_E$ given a flat beam tap is based on a geometrical effect (projective diminution of the emitting anode region) and on an x-ray-optical effect that supplies the main contribution (solid angle concentration due to refraction at the boundary surface of anode-to-vacuum). FIG. 2 shows the relative brilliance $$B_E(E_\nu, \alpha_2)/B_E(E_\nu, \alpha_2 = 90°)$$

for a conventional Cu-anode dependent on the photon energy $E_\nu$ and on the tap angle $\alpha_2$ for an electron energy $E_e = 30$ keV) as can be seen in FIG. 2, the brilliance of, for example, the Cu-$K_\alpha$ line can be increased by a factor 3 when the radiation is taken not at an angle $\alpha_2=6°$ as was hitherto standard, but at an angle $\alpha_2=0.8°$ (exit limit angle for Cu-$K_\alpha$ radiation in Cu: $\alpha_{2C}=0.4°$). The gain in brilliance for an extremely flat tap angle of $\alpha_2=0.2°$ is even considerably higher in the region of the high-energy limit of the bremsstrahlung continuum (factor 30 compared to the tap at $\alpha_2=6°$). It can also be seen that the photon flux can be spectral-selectively intensified or attenuated by a suitable selection of the angle $\alpha_2$. This is a decisive advantage in comparison to conventional x-ray tubes wherein the photon flux can be angle-selectively or spectral-selectively attenuated by employing monochromators, filters and diaphragms at the primary side or secondary side that improve the signal-to-background ratio, but it can never be elevated.

The spectral brilliance $B_E$ ($E_\nu$, $\alpha_2$) for the x-ray emerging from anode given excitation with a mono-energetic electron beam derives from the following relationship:

$$B_E = \frac{1}{4\pi} j_e \sin\gamma \frac{1}{\sin\alpha_2} \cdot \int_{z=0}^{\infty} dz\phi(z, E_\nu)\exp(-z|\mathrm{Im}\, k_{12}|)\left(\frac{\mathrm{Re}\, n_2}{\mathrm{Re}\, n_1}\right)|T_{12}|^2\, \mathrm{Re}\left(\frac{N_2 \sin\alpha_2}{N_1 \sin\alpha_1}\right) \quad (8)$$

| | |
|---|---|
| $j_e = \frac{{}^2N_e}{dt\, dA_1}$ | incident electron current density,<br>$N_e$: number of electrons<br>dt: time interval<br>$A_1$: beam cross section of the electron beam. |
| $j_e \sin\gamma$ | number of electrons per time unit and per area unit of the anode surface $A_0$. |
| $\frac{1}{\sin\alpha_2}$ | describes the diminution of the source area in the projection of the beam tap according to: $A_2 = A_0 \sin\alpha_2$. |
| $\Phi(z, E_\nu)$ | photon production as function of the creation depth z and of the photon energy $E_\nu$, which indicates the number of photons having the energy $E_\nu$ that are generated per incident electron having the energy $E_e$ in the depth z per depth interval dz; the nuclear charge number Z and the density row of the anode as well as the electron inclusion angle $\gamma$ are also parameters (J. I. Goldstein, Scanning Electron Microscopy and X-ray Microanalysis, Plenum Press, New York, 1981, pages 355 ff.) |
| $\exp(-z\|\mathrm{Im}\, k_{1z}\|)$ | attenuation factor of the radiation flux density of the emerging photons within the anode. |

$$\mathrm{Im}\, k_{1z} = \frac{2\pi E_\gamma}{hc}\left(\frac{1}{2}\left(((1-\delta)^2 - \beta^2 - \cos^2\alpha_2)^2 + 4(1-\delta)^2\beta^2\right)^{\frac{1}{2}} - ((1-\delta)^2 - \beta^2 - \cos^2\alpha_2)\right)^{\frac{1}{2}} \quad (9)$$

| | |
|---|---|
| $\left(\frac{\mathrm{Re}\, n_2}{\mathrm{Re}\, n_1}\right)\|T_{12}\|^2$ | transmission ratio of the photons through the anode surface<br>$n_1$: refractive index of the anode material,<br>$n_1 = 1 - \delta - i\beta$,<br><br>$n_2$: refractive index of the vacuum, $n_2 = 1$,<br>$T_{12}$: transmission coefficient<br>$\|T_{12}\|^2 = 0.5\|T_{12\perp}\|^2 + 0.5\|T_{12\parallel}\|^2$ (10)<br>$T_{12\perp} = 2n_1 \sin\alpha_1/(n_1 \sin\alpha_1 + n_2 \sin\alpha_2)$ (11)<br>$T_{12\parallel} = 2n_1 \sin\alpha_1/(n_1 \sin\alpha_2 + n_2 \sin\alpha_1)$ (12) |
| $\mathrm{Re}\left(\frac{n_2 \sin\alpha_2}{n_1 \sin\alpha_1}\right)$ | solid angle concentration;<br>ratio of the solid angle element in the anode material ($d\Omega = d\alpha_1 d\tau$) to the solid angle element in the vacuum ($d\omega_2 = d\alpha_2 d\tau$), wherein $d\tau$ is the expanse of the ray beam perpendicular to $d\alpha_1$ or, $d\alpha_2$. |

Figure 3:
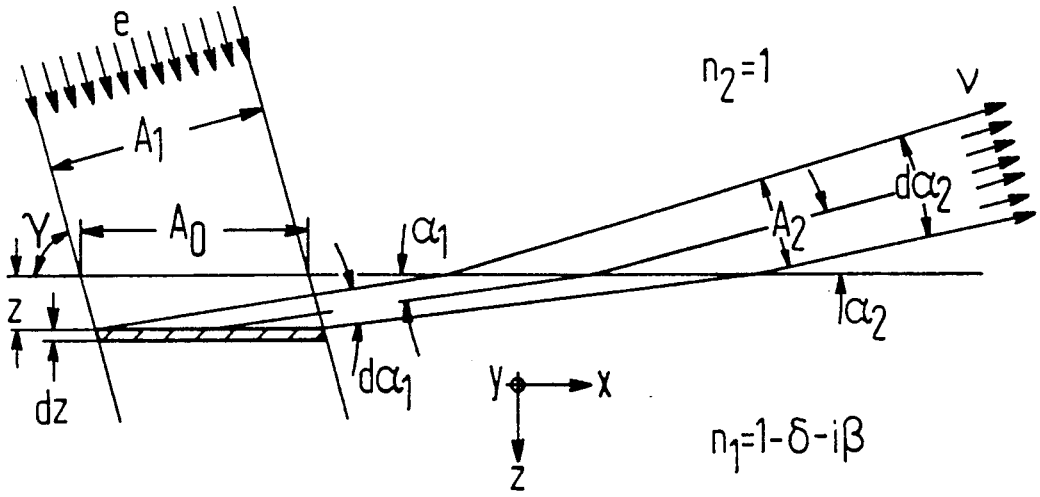
FIG. 3 is a schematic diagram showing the geometrical relationships at the emergence of the x-ray into the tube vacuum in an x-ray generator constructed in accordance with the principles of the present invention.

The beam geometry and the associated quantities are shown in FIG. 3.

Figure 4:
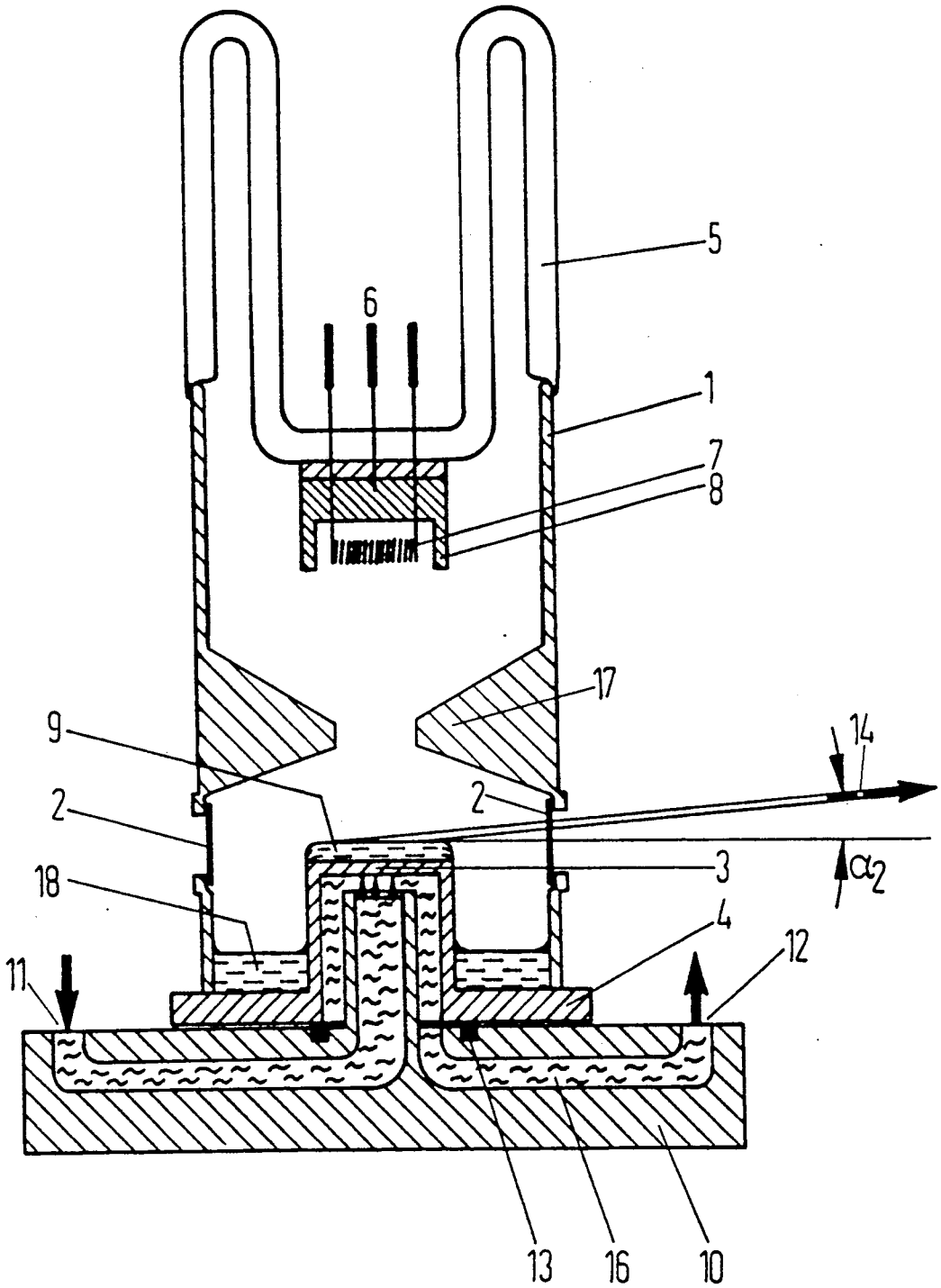
FIGS. 4 through 7, are respective side sectional views of further exemplary embodiments of x-ray generators constructed in accordance with the principles of the present invention.

FIG. 4 shows an x-ray generator wherein the electrons pass through a funnel-shaped constriction 17 between the glow helix 7 and the anti-cathode 9 that is fluid during operation. This constriction 17, acting as a hollow anode, also performs the function of re-coating the upper side 3 of the anode carrier with the anode fluid 18 which collects at the floor of the tube after the transport of the tube. For this purpose, the tube is briefly turned over and is again erected upright, so that the fluid 18 impinges the upper side 3 of the anode carrier arranged under the hollow anode and completely moistens it. A rim at the upper side 3 of the carrier and projecting in the direction of the cathode 7 cannot be used because this would impede the desired, flat beam tap.

Figure 5:
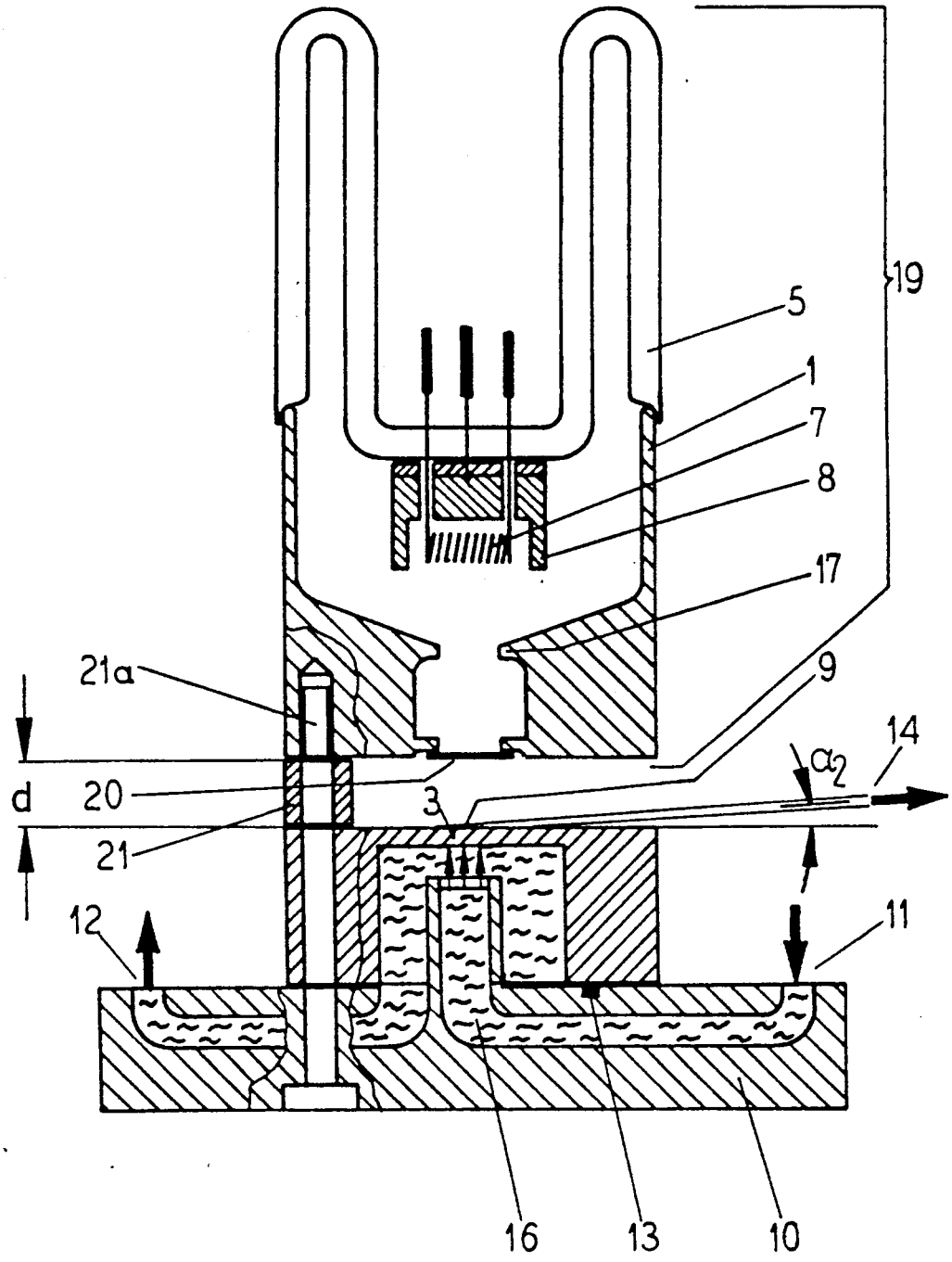

The exemplary embodiment of FIG. 5 shows an x-ray generator wherein the electrons emitted by the cathode 7 and accelerated in the direction of the hollow anode 17 pass through a window 20 that terminates the housing 19 vacuum-tight in order to generate bremsstrahlung and characteristic x-radiation 14 in the anode fluid 9 arranged outside the housing 19 on the water-cooled upper side 3 of the carrier. A screw 21*a* extends through the flange 10, the carrier 3, as spacer 21 and into the housing 19. As a result of the flat beam tap, the height of the spacer 21 can be selected extremely low (d<1 mm), so that no noteworthy electron absorption occurs in the atmosphere. Given the use of 0.5 μm thick Quantum as the window material (obtainable from Kevex Corporation Foster City, Calif.), the absorption in the electron exit window 20 also remains extremely low. Because low vapor pressure is not required for the materials used as the anode sodium and mercury also come into consideration as anode materials in addition to gallium, indium and tin. An advantage of the beam generators set forth herein is that the low-energy spectral components can also be experimentally utilized.

Figure 6:
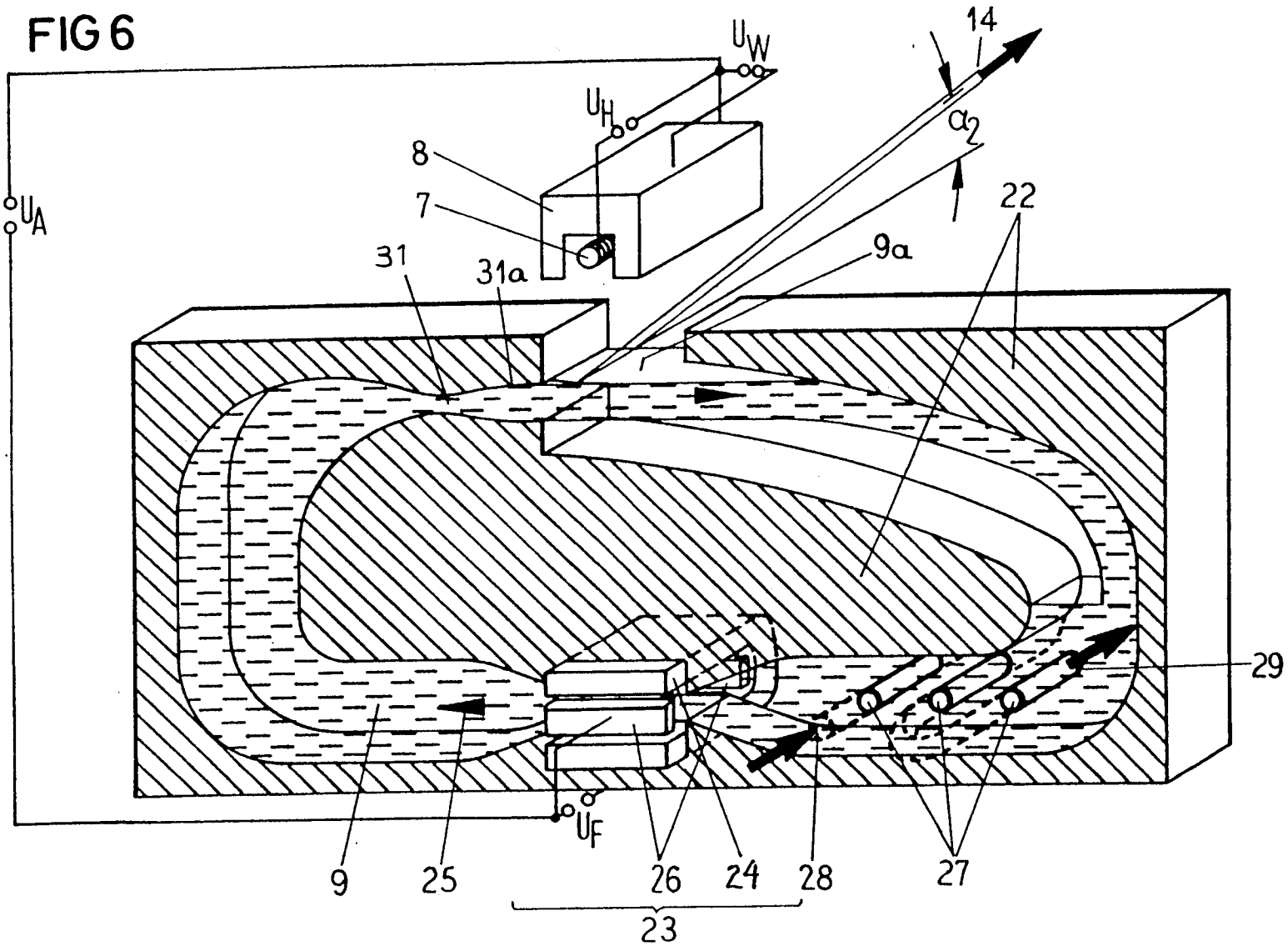

The exemplary embodiment of FIG. 6 shows an x-ray generator whose anode is formed by an electrically conductive liquid 9 having low vapor pressure. A Faraday pump 23 whose horseshoe magnet 24 generates a magnetic field oriented perpendicular to the desired flow direction 25 is provided for circulating the anode fluid 9 guided in an insulating member 22. An electrical current flowing between the electrodes 26 perpendicularly relative to the magnetic field direction and flow direction 25 provides the Lorentz force that accelerates the anode fluid 9. The heated anode fluid 9 is cooled in a heat exchanger 27 in the return flow region. The cooling water enters the heat exchanger 27 through the opening 28 and emerges at the discharge 29. The nozzle 30 (Laval nozzle) provided in the channel of the anode fluid 9 serves the purpose of matching the magnetic circulating pressure to the gas pressure $p<10(-9)$ bar present in the housing to guarantee a smooth boundary surface 31*a* of the exposed portion 9*a* of the anode fluid 9 flowing from the nozzle 30 to the point of incidence 31 of the electron beam. As initially mentioned, this is an indispensable prerequisite for the applicability of the beam tap at the critical angle of the total reflection.

The arrangement composed of the ceramic insulating member 22, of the cathode 7 and of the focusing unit 8 (Wehnelt electrode, focusing trough or Pierce electrode) is situated in an evacuated housing (not shown) that has vacuum-tight voltage and coolant lead-throughs as well as windows for the emergence of the x-radiation 14 taken at an angle $\alpha_2$.

In the illustrated exemplary embodiment, the fluid 9 heated by the electron beam is very quickly replaced and supplied to the cooling unit 27. The comparatively low thermal conductivity of the anode materials of gallium, indium and tin employed does not have a disadvantageous effect since the anode fluid 9 stores the heat and very rapidly emits it in turn as a consequence of the blending in the return flow region. The electron beam thus constantly impinges the cooled, inflowing fluid, as a result whereof the allowable power density of the electron beam can be significantly increased compared to a non-circulated liquid anode.

Figure 7:
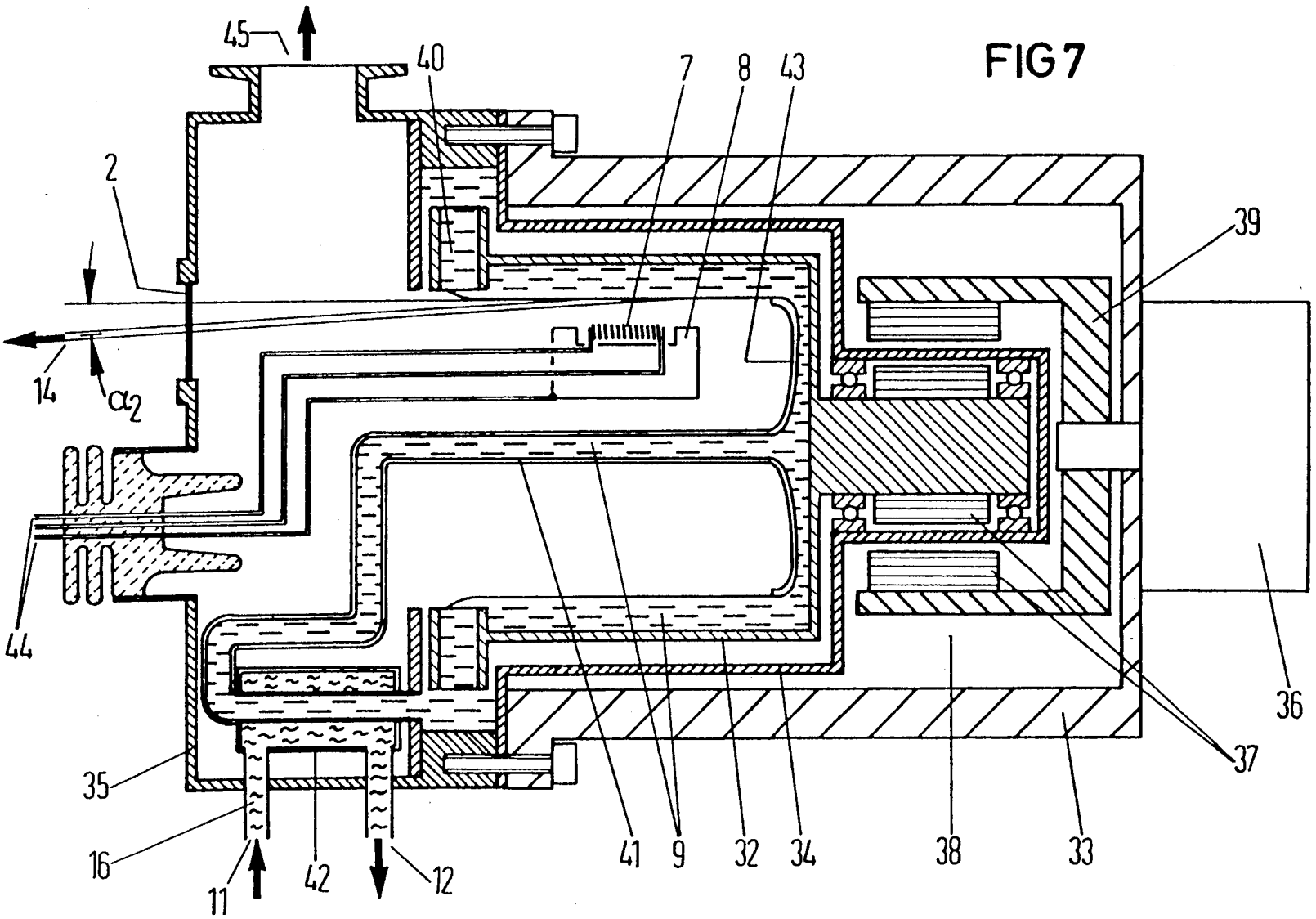

In the exemplary embodiment shown in FIG. 7, the anode liquid 9 is circulated with the assistance of a rotating drum 32. A housing is formed by joined housing components 34 and 35. An electric motor 36 rigidly connected to the evacuated housing via a carrier 33 serves as a drive unit, with a coupling 38, composed of two magnets 37 lying opposite one another, transmitting the rotatory motion of an outer cylinder 39 to the drum 32. Based on the principle of the rotatory pump, the paddle wheels 40 of the rotating drum 32 exert a pressure on the anode fluid 9 flowing off at the open end faces, so that this fluid 9 is placed in motion tubing 41. The fluid flows through a heat exchanger 42 and through the central tube 41 to emerge via diffusor 43. The anode fluid 9 is stopped at that location by the rotating drum 32 and is pressed against the inside wall due to the centrifugal force. The fluid subsequently flows away via the paddle wheels 40, so that the pressure required for the circulation is again generated. The electrons emitted by the cathode 7 are accelerated by high-voltage supplied via the terminals 44 and are focused onto the anode fluid 9 with the assistance of a Pierce or Wehnelt electrode 8. The electrons generate bremsstrahlung and characteristic x-radiation 14 here, which is again taken at a flat angle $\alpha_2$ and which emerges through the window 2. A vacuum pump (not shown in FIG. 7), particularly a turbomolecular pump that extracts the residual gas via the connector 45 is employed evacuating the housing. A vacuum seal, particularly a gold wire seal, is provided between the two housing parts 34 and 35.

The invention, of course, is not limited to the described exemplary embodiments. Thus, it is possible to replace the above-described drum with a rotating disc, whereby the anode fluid emerges from a hollow shaft that carries the disc and moistens the surface of the disc.

Although other modifications and changes may be suggested by those skilled in the art, it is the intention of the inventor to embody within the patent warranted hereon all changes and modifications as reasonably and properly come within the scope of their contribution to the art.

I claim as my invention:

1. An x-ray generator comprising:

a cathode disposed in an evacuated housing;

an anti-cathode consisting of an electrically conductive fluid;

means for focusing particles emitted by said cathode onto said anti-cathode to generate x-rays emerging from a surface of said anti-cathode, with $\alpha_{2C}$ being the critical angle of total reflection at said surface; and means for defining a tap angle $\alpha_2$ of said x-rays satisfying the condition $$\alpha_{2C}<\alpha_2<3\alpha_{2C}.$$

2. An x-ray generator as claimed in claim 1 wherein said electrically conductive fluid is a metallic melt.

3. An x-ray generator as claimed in claim 1 wherein said housing has a particle-transmissive window through which said particles pass, and wherein said anti-cathode is disposed outside of said housing.

4. An x-ray generator as claimed in claim 1 further comprising an anode disposed inside said housing between said cathode and said anti-cathode.

5. An x-ray generator as claimed in claim 4 wherein said anode is a hollow anode.

6. An x-ray generator as claimed in claim 1 further comprising means for circulating said electrically conductive fluid.

7. An x-ray generator as claimed in claim 6 wherein said means for circulating the electrically conductive fluid is a Faraday pump.

8. An x-ray generator as claimed in claim 6 wherein said means for circulating the electrically conductive fluid is a means for circulating the electrically conductive fluid in a closed circulation path.

9. An x-ray generator as claimed in claim 1 further comprising;

a carrier on which said electrically conductive fluid is disposed; and means for cooling said carrier.

10. An x-ray generator as claimed in claim 1 further comprising a drum rotatable around a shaft, said drum having an interior wall wetted by said electrically conductive fluid.

11. An x-ray generator as claimed in claim 10 further comprising a motor magnetically coupled to said drum for rotating said drum around said shaft.

12. A method for generating x-rays comprising:

heating a cathode to cause particles to be emitted by said cathode in an evacuated housing;

focussing said particles from said cathode onto an anti-cathode consisting of an electrically conductive fluid thereby generating x-rays at said surface of said fluid, with $\alpha_{2C}$ being the critical angle of total reflection at said surface; and tapping x-rays from said solid angle at a tap angle $\alpha_2$ which satisfies the condition $$\alpha_{2C}<\alpha_2<3\alpha_{2C}.$$

13. A method as claimed in claim 12 comprising the additional step of:

maintaining said electrically conductive fluid at a temperature lower than the temperature of said housing.

14. A method as claimed in claim 13 comprising the additional step of:

circulating said electrically conductive fluid.

* * * * *